US010207393B2

(12) United States Patent
Wu

(10) Patent No.: US 10,207,393 B2
(45) **Date of Patent: *Feb. 19, 2019**

(54) LOCKING PLIERS

(71) Applicant: Ming Chieh Wu, Taichung (TW)

(72) Inventor: Ming Chieh Wu, Taichung (TW)

( * ) Notice: Subject to any disclaimer, the term of this patent is extended or adjusted under 35 U.S.C. 154(b) by 683 days.

This patent is subject to a terminal disclaimer.

(21) Appl. No.: 14/485,884

(22) Filed: Sep. 15, 2014

(65) Prior Publication Data

US 2015/0000477 A1 Jan. 1, 2015

Related U.S. Application Data

(63) Continuation-in-part of application No. 13/469,469, filed on May 11, 2012, now Pat. No. 8,950,299.

(30) Foreign Application Priority Data

Jul. 12, 2011 (TW) ..... 100124592 A

(51) Int. Cl.
*B25B 7/12* (2006.01)

(52) U.S. Cl.
CPC ..... *B25B 7/123* (2013.01)

(58) Field of Classification Search
CPC ..... B25B 7/123; B25B 7/14; B25B 7/02
USPC ..... 81/379
See application file for complete search history.

(56) References Cited

U.S. PATENT DOCUMENTS 1,867,912 A 7/1932 Evcy
2,519,630 A * 8/1950 Boyer ..... B25B 7/10 81/373
3,262,343 A * 7/1966 Weller ..... B25B 7/123 81/370
3,710,658 A * 1/1973 Wilson ..... B25B 7/123 81/367
3,894,451 A 7/1975 Putsch
4,499,797 A 2/1985 Wilson
4,989,479 A 2/1991 Anderson et al.
5,056,385 A 10/1991 Petersen
(Continued)

FOREIGN PATENT DOCUMENTS

CN 101659014 3/2010
CN 101704227 5/2010
(Continued)

OTHER PUBLICATIONS

European Search Report from European Application 12170983.6-1251, dated Oct. 22, 2012, 7 pages.

*Primary Examiner* — Hadi Shakeri
(74) *Attorney, Agent, or Firm* — Alan D. Kamrath; Kamrath IP Lawfirm, P.A.

(57) ABSTRACT

A locking pliers includes a fixed handle. A fixed jaw is connected to the fixed handle. A movable jaw cooperates with the fixed jaw and includes movable and fixed pivoting regions. A movable handle is pivotally connected to the movable pivoting region. A movable pivot unit includes a pivot pin engaging with the fixed handle and the fixed pivoting region, and a pivot hole is disposed in one of the fixed handle and the fixed pivoting region and configured and dimensioned to loosely receive the pivot pin. The pivot hole has a first diametrical size and the pivot pin has a second diametrical size not greater than 0.8 times the first diametrical size. A biasing member engages with the fixed handle and the movable jaw.

13 Claims, 14 Drawing Sheets

(56) References Cited

U.S. PATENT DOCUMENTS

| | | | | |
|---|---|---|---|---|
| 5,351,585 | A | 10/1994 | Leseberg et al. | |
| 5,456,144 | A * | 10/1995 | Dahl | B25B 7/02 269/6 |
| 5,460,065 | A | 10/1995 | Balmer | |
| 5,520,040 | A | 5/1996 | Pettersson | |
| 6,393,951 | B1 | 5/2002 | Jansson | |
| 6,626,070 | B2 | 9/2003 | Peperkom et al. | |
| 6,862,962 | B1 * | 3/2005 | Delbrugge, Jr. | B25B 7/10 81/355 |
| 7,143,671 | B1 | 12/2006 | Lai | |
| 7,216,570 | B2 | 5/2007 | Seber et al. | |
| 7,454,999 | B2 | 11/2008 | Wu | |
| 7,472,632 | B2 | 1/2009 | Engvall et al. | |
| 7,861,622 | B2 | 1/2011 | Chervenak et al. | |
| 8,056,451 | B2 | 11/2011 | Chervenak et al. | |
| D651,060 | S | 12/2011 | Chervenak et al. | |
| 8,950,299 | B2 | 2/2015 | Wu | |
| 2008/0196561 | A1 | 8/2008 | Wu | |
| 2010/0018361 | A1 | 1/2010 | Chervenak et al. | |
| 2014/0251093 | A1 | 9/2014 | Lai | |

FOREIGN PATENT DOCUMENTS

| | | | |
|---|---|---|---|
| EP | 2149428 | A1 | 2/2010 |
| TW | M265172 | | 5/2005 |
| TW | M313580 | | 6/2007 |
| TW | 200924914 | | 6/2009 |
| TW | M400919 | | 4/2011 |

* cited by examiner

LOCKING PLIERS

CROSS REFERENCE TO RELATED APPLICATION

The present application is a continuation-in-part application of U.S. patent application Ser. No. 13/469,469 filed on May 11, 2012, now U.S. Pat. No. 8,950,299, of which the entire disclosure is incorporated herein.

BACKGROUND OF THE INVENTION

1. Field of the Invention

This invention relates to a locking pliers and, more particularly, to a locking pliers that can be held firmly in a closed and locked position without the continuous application of force by a user while tightly gripping a workpiece.

2. Description of the Related Art

Referring to FIG. 1, a conventional locking pliers 10 disclosed in U.S. Pat. No. 7,861,622 B2 is shown to include a fixed handle 11 supporting a fixed jaw 12, a movable jaw 14 pivotally connected to the fixed handle 11 by a first pivot pin 13, a movable handle 16 pivotally connected to the movable jaw 14 by a second pivot pin 15, and a toggle-link locking mechanism 17 disposed to lock the movable jaw in a closed, locked position. The fixed handle 11 has an oval slotted aperture 111 such that the first pivot pin 13 is movable in the aperture 111 during use of the pliers 10. A long axis of the aperture 111 is arranged at an angle $\alpha$ with respect to a line extending through the center of the closed jaws 12 and 14. The angle $\alpha$ is approximately 15 degrees. The locking mechanism 17 has a link 173 pivotally connected to the movable handle 16 and in sliding and pivoting contact with an adjustment screw 171, and a biasing member 172 extending between the movable jaw 14 and the fixed handle 11 to bias the jaws 12 and 14 away from each other.

Referring to FIGS. 2 and 3, in operation, when the pliers is first locked onto a workpiece 20 and a turning force is applied to the pliers, the movable jaw 14 rotates clockwise around the second pivot pin 15 toward the fixed jaw 12 to allow a rearward movement of the first pivot pin 13 in the aperture 111. The movable jaw 14 is also moved rearward and toward the fixed jaw 12, as indicated by arrows 21 and 22, to increase the gripping force on the workpiece 20. Since the first pivot pin 13 is moved to a rear end of the aperture 111 when the jaws 12 and 14 are operated to the closed, locked position, the design of the aperture 111 is critical. However, the aperture 111 does not prevent a problem that a sliding engagement of the first pivot pin 13 with a wall defining the aperture 111 may be unstable. Therefore, the gripping force on the workpiece 20 is adversely affected. In addition, the aperture 111 has to be made precisely. If the axis of the aperture 111 suffers deviations from the angle $\alpha$, the first pivot pin 13 can not move stably or even move rearward in the aperture 111.

SUMMARY OF THE INVENTION

An objective of the present invention is to provide a locking pliers which can exert a firm and stable gripping force onto a workpiece while being held firmly in a closed and locked position without continuous application of force by a user.

According to this invention, the locking pliers includes a fixed handle. A fixed jaw is connected securely to the fixed handle and includes a first clamping surface. A movable jaw cooperates with the fixed jaw and includes a second clamping surface and movable and fixed pivoting regions. A movable handle is pivotally connected to the movable pivoting region about a pivotal axis. A movable pivot unit includes a pivot pin engaging with the fixed handle and the fixed pivoting region and includes a pivot hole disposed in one of the fixed handle and the fixed pivoting region and configured and dimensioned to loosely receive the pivot pin. The pivot hole has a first diametrical size, and the pivot pin has a second diametrical size not greater than 0.8 times the first diametrical size. A biasing member engages with the fixed handle and the movable jaw, with the fixed handle and the movable jaw subject to a tensional force of the biasing member.

Upon changing the locking pliers from initial, locking, to tightening positions thereof, the pivot pin has an annular trajectory in the pivot hole, the movable jaw is pivoted closer toward the fixed jaw, and the pivot pin is in an abutting engagement with trailing, middle and leading regions defined from a contour of the pivot hole, respectively.

Other objectives, advantages, and new features of the present invention will become apparent from the following detailed description of the invention when considered in conjunction with the accompanied drawings.

DETAILED DESCRIPTION OF THE INVENTION

Figure 1:
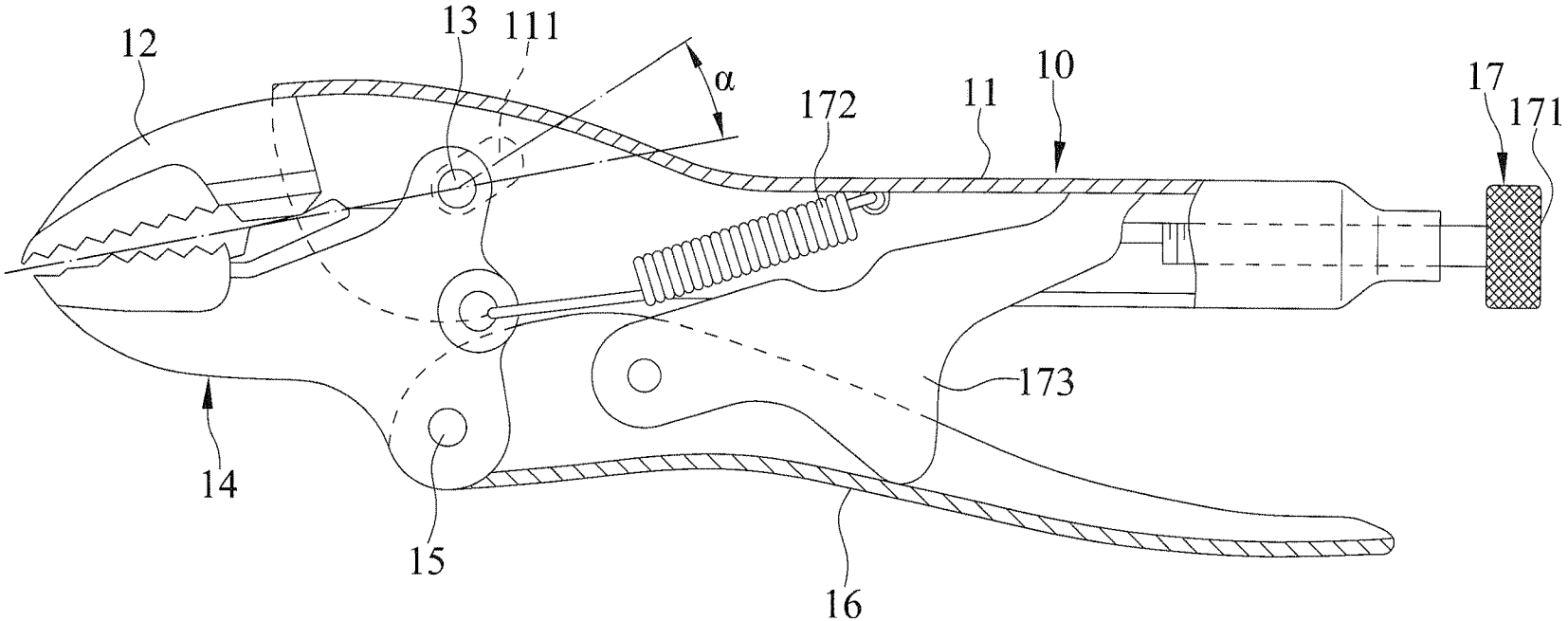
FIG. 1 PRIOR ART
FIG. 1 is a partially sectioned side view of a conventional locking pliers disclosed in U.S. Pat. No. 7,861,622 B2 in a closed and locked position.
Figure 2:
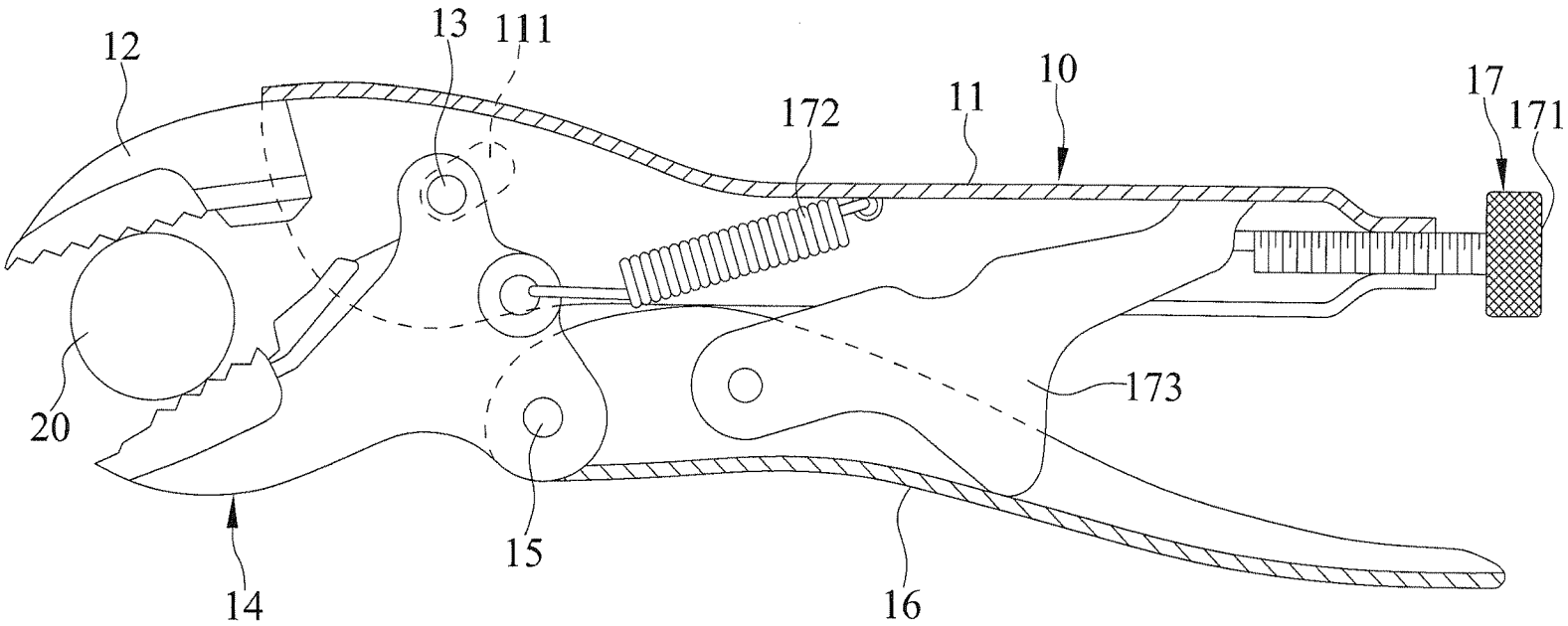
FIG. 2 PRIOR ART
FIG. 2 is a partially sectioned side view of the conventional locking pliers in its closed, locked position on a workpiece.
Figure 3:
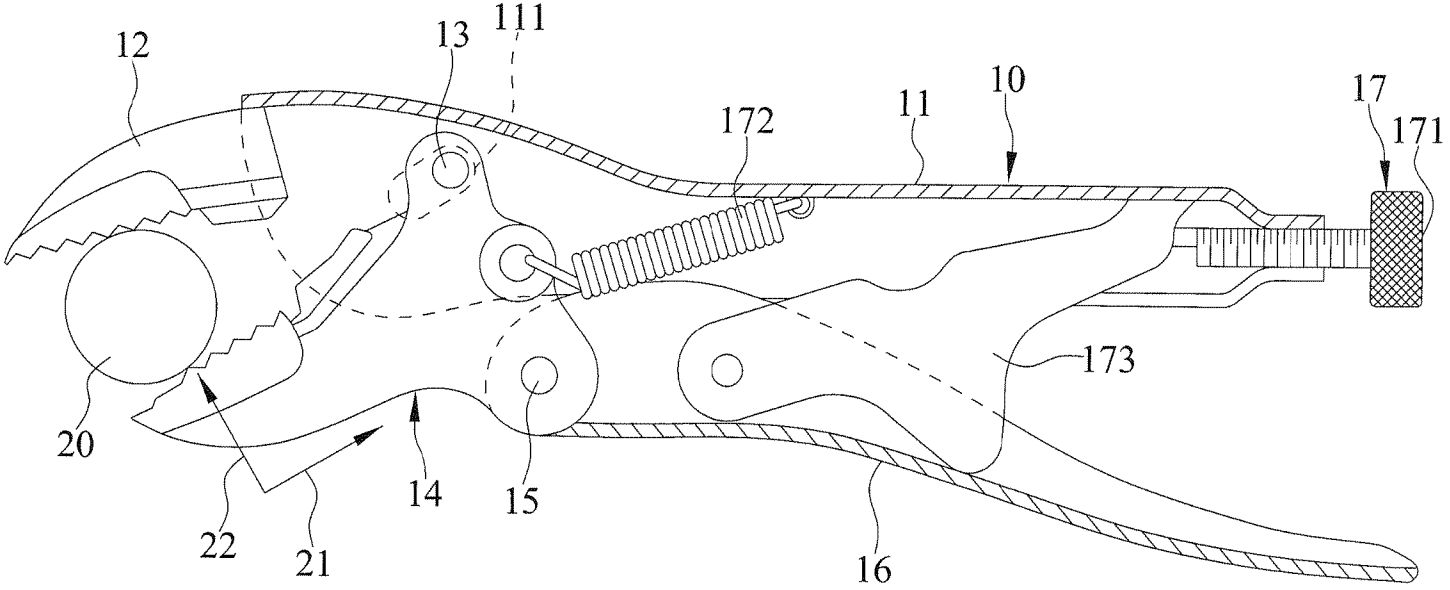
FIG. 3 PRIOR ART
FIG. 3 is a partially sectioned side view of the conventional locking pliers in its closed, locked position on a workpiece with a turning force applied to the pliers.
Figure 4:
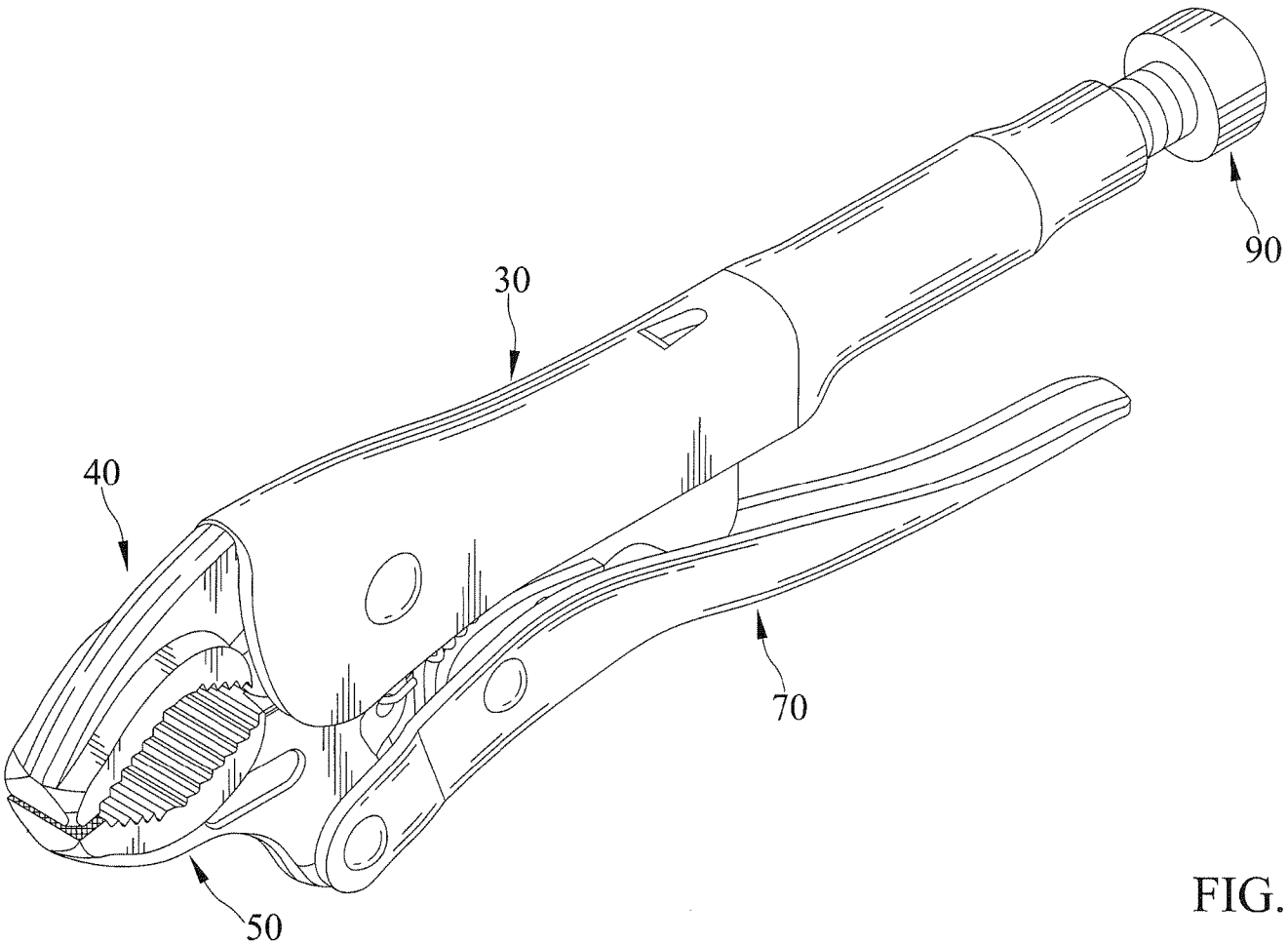
FIG. 4 is a perspective view of the preferred embodiment of a locking pliers according to this invention.
Figure 5:
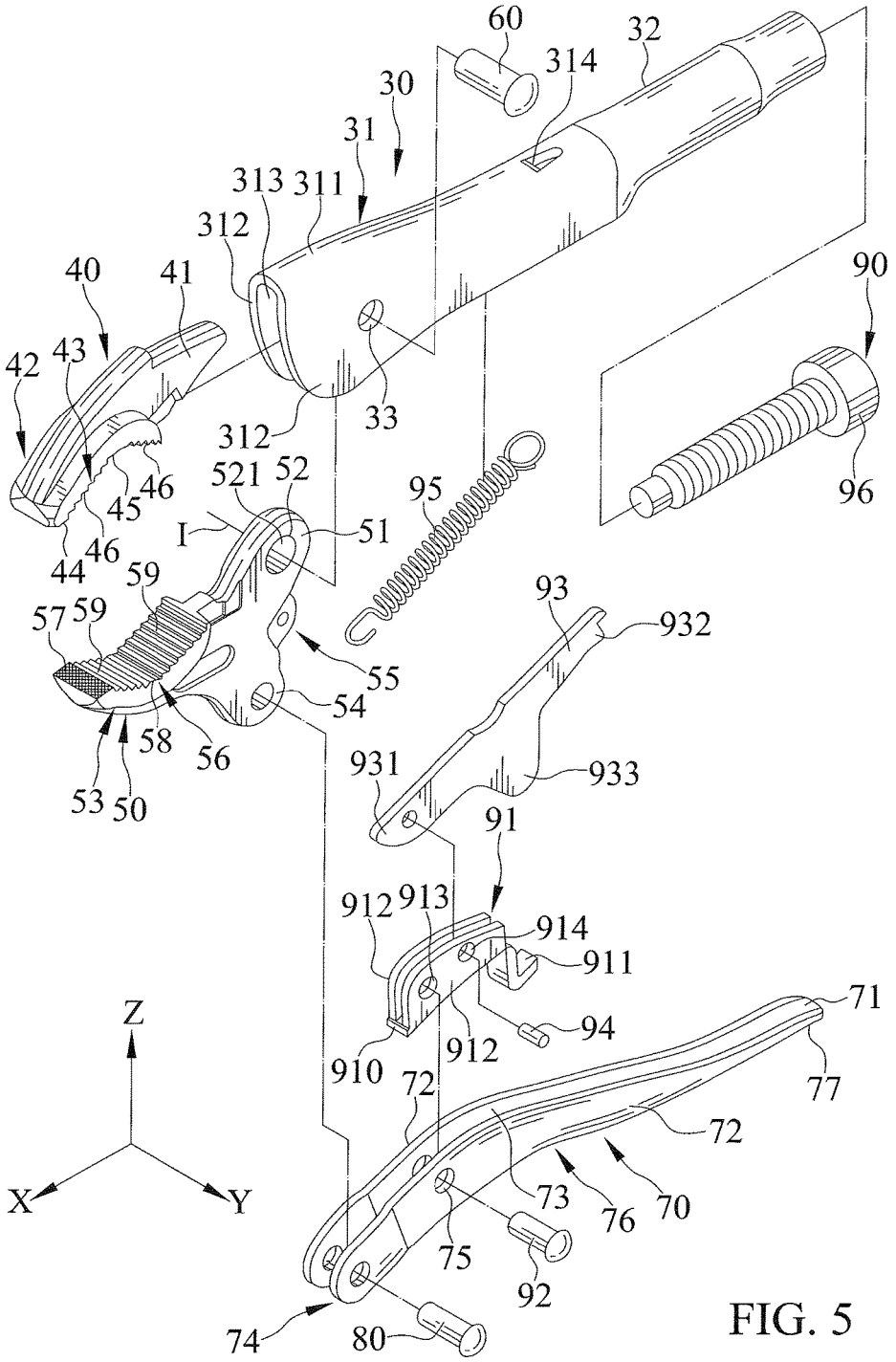
FIG. 5 is an exploded perspective view of the preferred embodiment of a locking pliers according to this invention.
Figure 6:
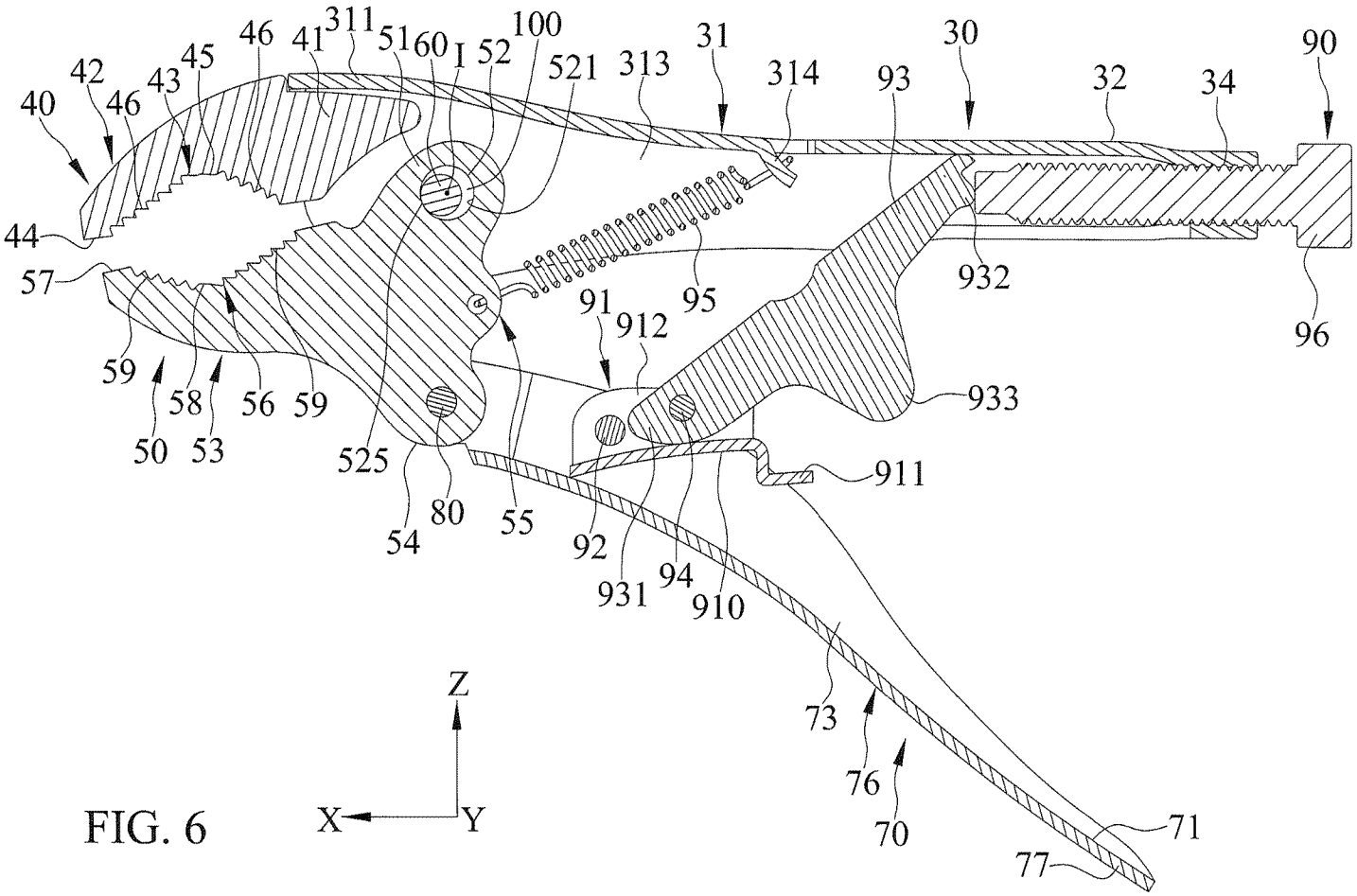
FIG. 6 is a partially sectioned side view of the preferred embodiment in an opened state.

Referring to FIGS. 4 through 6, the preferred embodiment of a locking pliers according to the present invention is shown to comprise a fixed handle 30, a fixed jaw 40, a movable jaw 50, a movable handle 70, a movable pivot unit, a biasing member 95, and a lock unit 90.

The fixed handle 30 has front and rear handle portions 31 and 32 opposite to each other in a longitudinal direction X. A pivot hole 33 and a screw hole 34 are formed in the front handle portion 31 and the rear handle portion 32, respectively. In this embodiment, the front handle portion 31 is in the form of a grooved plate which includes an upper plate 311 and a pair of side plates 312 extending from the upper plate 311 in a transverse direction Z, which is transverse to the longitudinal direction X, to cooperatively define a recess 313. The pivot and screw holes 33 and 34 are communicated with the recess 313. A tab 314 extends from the upper plate 311 and into the recess 313.

The fixed jaw 40 has a first connected portion 41 which is connected securely to the front handle portion 31, and a first working portion 42 which extends forward in the longitudinal direction X from the first connected portion 41 and terminates at a first nose end 44 having a flat surface. The first working portion 42 has a fixed clamping surface 43 that is disposed immediately rearward in the longitudinal direction X from the first nose end 44 and that faces in the transverse direction Z and that is formed with gripping teeth 46 extending from the first nose end 44 along a concaved contour 45.

The movable jaw 50 has a second connected portion 55 which extends in the transverse direction Z to terminate at fixed and movable pivoting regions 51 and 54, and a second working portion 53 which extends forward in the longitudinal direction X from the second connected portion 55 and terminates at a second nose end 57 having a flat surface. The second working portion 53 has a movable clamping surface 56 that is disposed immediately rearward in the longitudinal direction X from the second nose end 57 and that confronts the fixed clamping surface 43 and that is formed with gripping teeth 59 extending rearward from the second nose end 57 along a concaved contour 58.

The movable handle 70 has a front pivot portion 74 which is pivotally connected to the movable pivoting region 54 by a pivotal pin 80 about a pivotal axis, which has a fixed position, in an axial direction Y that is transverse to the longitudinal and transverse directions X and Z, and a rear actuating portion 76 which extends rearward from the front pivot portion 74 in the longitudinal direction X and terminates at a movable handle end 77 that is manually operable. In this embodiment, the movable handle 70 is in the form of a grooved plate which includes a base seat 71 and a pair of wings 72 that extend from the base seat 71 in the transverse direction Z and that are spaced apart from each other in the axial direction Y to cooperatively define a concavity 73.

Figure 14:
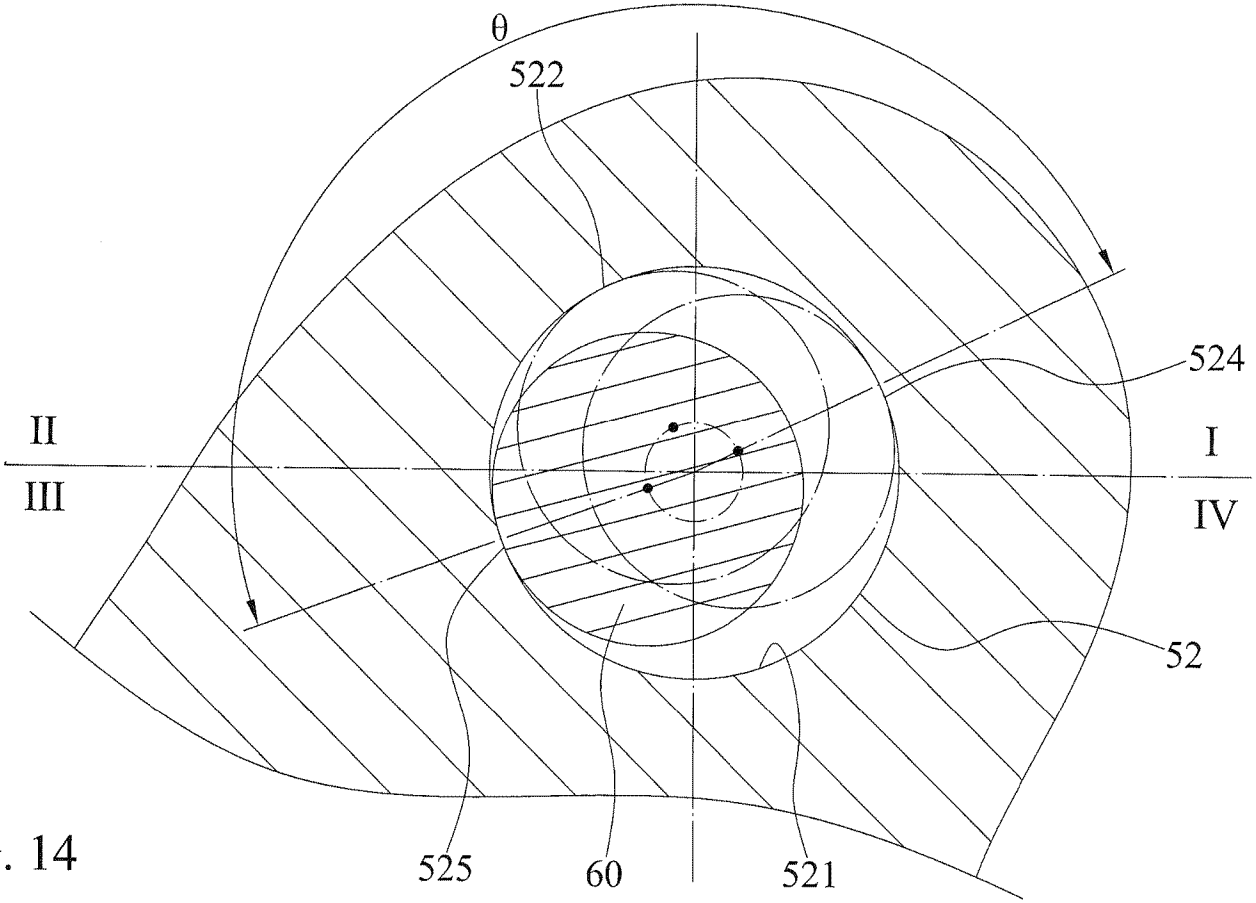
FIG. 14 is a fragmentary sectional view of a movable pivot unit of the preferred embodiment.

Referring to FIGS. 6 and 14, a movable pivot unit includes a pivot pin 60 and a pivot hole 52. The pivot pin 60 is disposed on the front handle portion 31 through the pivot hole 33 and extends along a pivot axis parallel to the pivotal axis of the pivotal pin 80. The pivot pin 60 has a circular contour. The pivot hole 52 is disposed in the fixed pivoting region 51 of the movable jaw 50. Alternatively, the pivot pin 60 may be disposed on the fixed pivoting region 51 of the movable jaw 50 while the pivot hole 52 is disposed in the front handle portion 31. The pivot hole 52 has an inner periphery defining an inner tubular surface 521. The inner tubular surface 521 has a circular contour. A central axis I extends through a center of the pivot hole 52. The inner tubular surface 521 of the pivot hole 52 includes the contour thereof defining a first contour section and a second contour section. The first and second contour sections delimit the inner periphery of the pivot hole 52. The first contour section is opposite the second contour section. Leading, middle and trailing regions 524, 522, and 525 extend one after another and are angularly displaced from one another about the central axis I and are defined on the first contour section of the inner tubular surface 521. The first contour section of the inner tubular surface 521 includes the leading, middle, and trailing regions 524, 522, and 525 sequentially in a counterclockwise direction. The pivot hole 52 has a diameter larger than that of the pivot pin 60. The pivot hole 52 has a diametrical size D. The pivot pin 60 has a diametrical size 0.8D. The pivot pin 60 having a diametrical size not greater than 0.8D is also within the scope of the invention. In this embodiment, a subtended angle θ by the first contour section at the center of the pivot hole 52 ranges from 180 degrees to 270 degrees. Accordingly, a subtended angle by the second contour section at the center of the pivot hole 52 may ranges from 90 degrees to 180 degrees. The pivot pin 60 is angularly displaceable relative to and is able to be in continuous contact with the first contour section of the inner tubular surface 521 upon changing the locking pliers among initial, locking, and tightening positions thereof. The pivot pin 60 is in abutting engagement with the trailing, middle and leading regions 525, 522, and 524, respectively, and a center of the pivot pin 60 is displaceable in III, II, and I quadrants, respectively. The pivot pin 60 is displaceable in an annular trajectory as it moves on the trailing, middle, and leading regions sequentially 525, 522, and 524 or in reverse, and the movable clamping surface 56 is close, closer and closest to the fixed clamping surface 43, respectively, as will be described hereinafter. Since the pivot pin 60 moves in an annular trajectory, it is subject to a horizontal component force and a vertical component force. The vertical component force helps maintain the pivot pin 60 in a continuous contact with the first contour section of the inner tubular surface 521 of the pivot hole 52 when the pivot pin 60 moves on the trailing, middle and leading regions 525, 522, and 524.

The biasing member 95 is connected to the tab 314 and the second connected portion 55 to bias the movable jaw 50. Therefore, the fixed handle 30 and the movable jaw 50 are subject to a tensional force of the biasing member 95. The biasing member 95 is released from tension when the locking pliers is in the initial position thereof. In this embodiment, the biasing member 95 is a tension spring.

The lock unit 90 is a toggle locking assembly which includes a linkage interconnecting the fixed and movable handles 30 and 70. The linkage includes a first linkage 91 and a second linkage 93. The first linkage 91 is disposed in the concavity 73 and has a first proximate end 913 pivotally connected to the rear actuating portion 76 of the movable handle 70 by a first linking pin 92 about a first linking axis and a first distal end 914. In this embodiment, the first linkage 91 is a grooved plate and has a lever wall 910 that extends rearward in the longitudinal direction X and terminates at a power end 911 and a pair of side walls 912 that extend in the transverse direction Z from the lever wall 910. The second linkage 93 has a second proximate end 931 which is pivotally connected to the first distal end 914 by a second linking pin 94 about a second linking axis, a second distal end 932 that is disposed in the recess 313 and slidably and retainingly engaged with the rear handle portion 32 and that is contact with an adjustment screw 96 which is threadedly engaged with the screw hole 34, and a protrusion 933 which extends rearward to serve as a stop. The adjustment screw 96 can be operated to adjust a separating distance between the fixed and movable jaws 40 and 50. Accordingly, the protrusion 933 abuts against and stops on the base seat 71 when the locking pliers is in the tightening position thereof.

In this embodiment, each of the pivot pin 60, the pivotal pin 80, and the first and second linking pins 92 and 94 is a rivet.

During operation, as shown in FIG. 6, when the locking pliers is in the initial position thereof, the movable handle 70 is disposed away from the fixed handle 30, the power end 911 of the first linkage 91 is turned by the second linkage 93 about the first linking axis to be spaced apart from the base seat 71 in the transverse direction Z, and the pivot pin 60 is in abutting engagement with the trailing region 525 and is spaced apart from the leading region 524 by a clearance 100. In addition, the pivot pin 60 is disengaged from the second contour section of the inner tubular surface 521 of the pivot hole 52.

Figure 7:
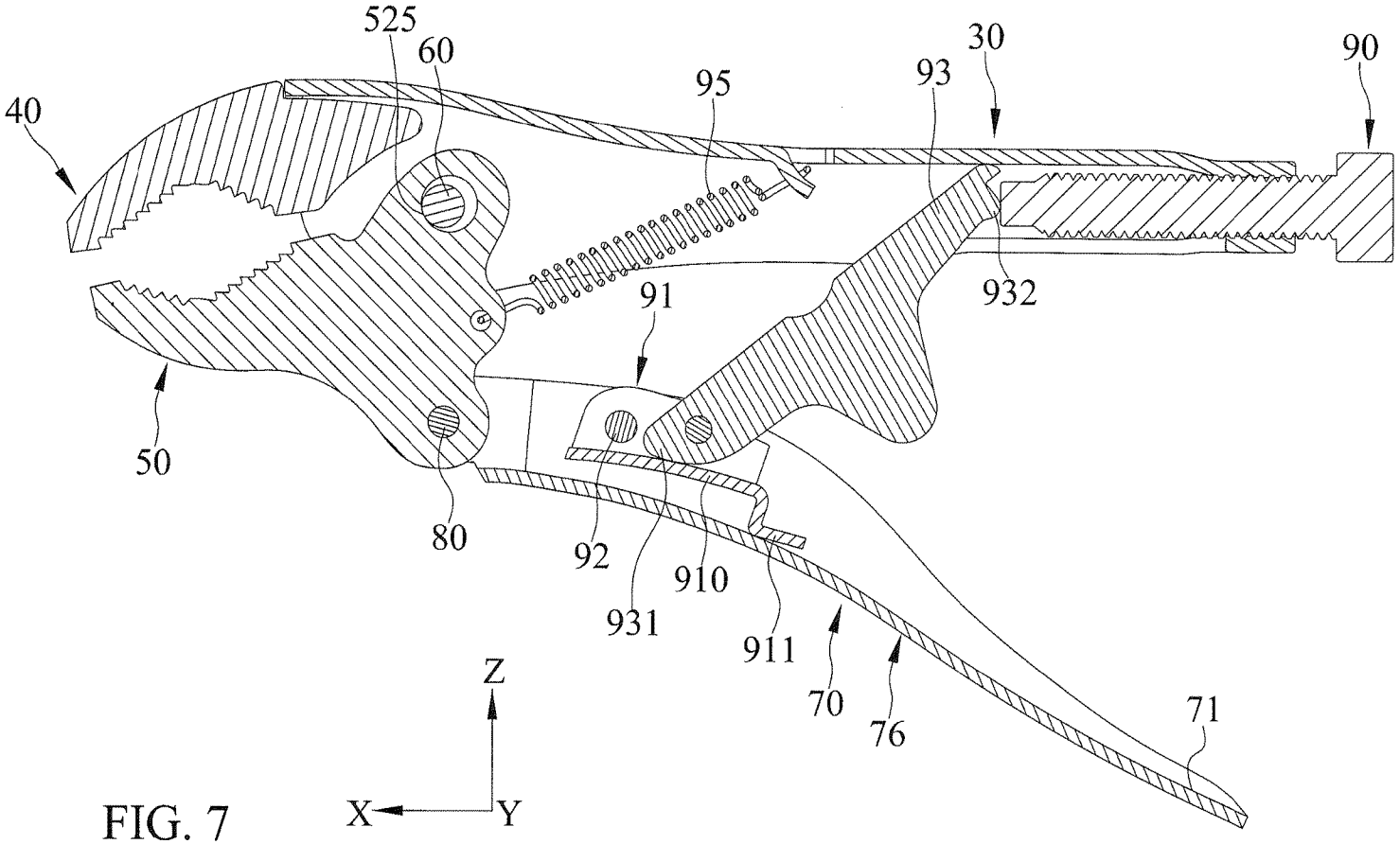
FIG. 7 is a partially sectioned side view of the preferred embodiment in an initially operating state.
Figure 8:
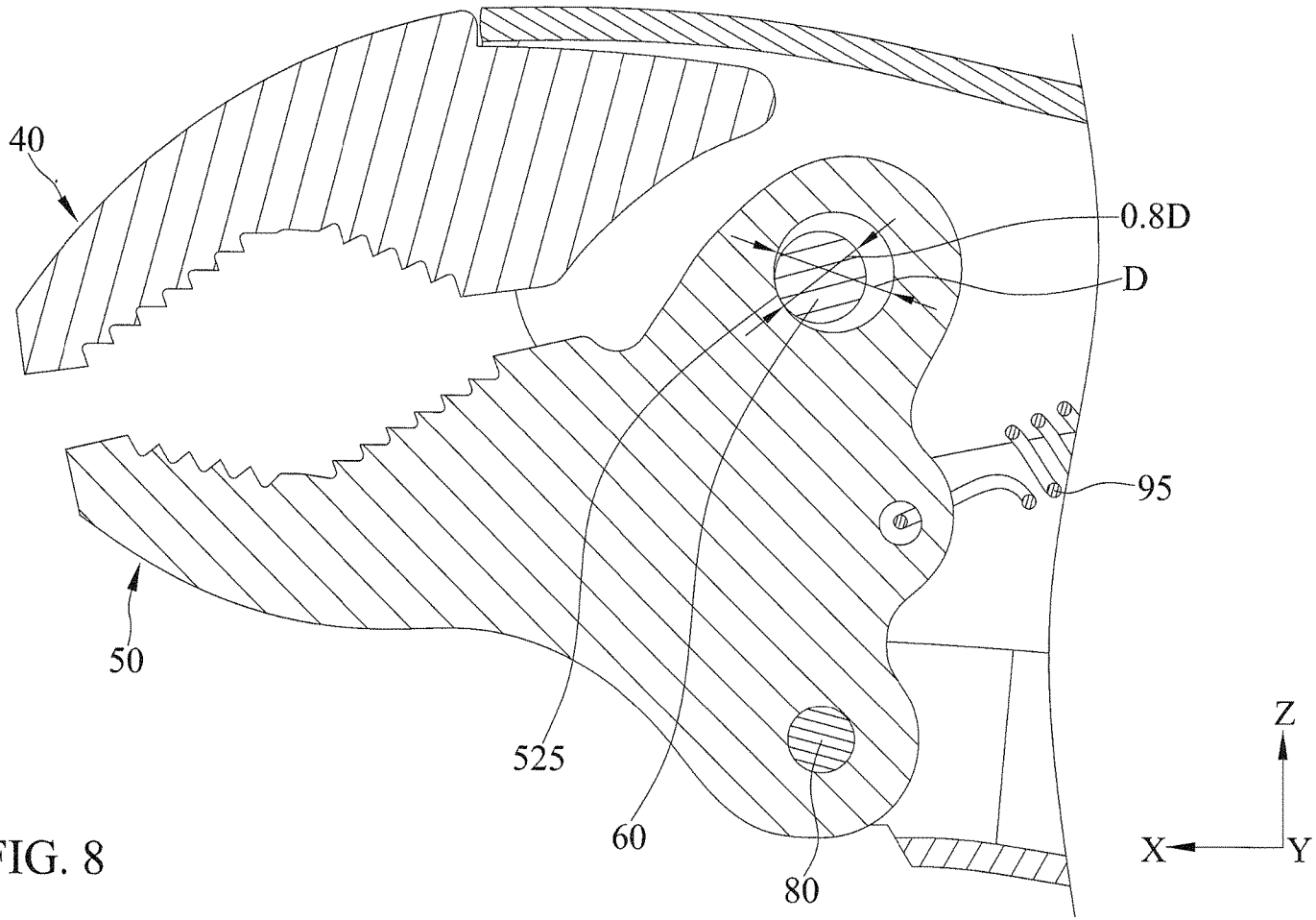
FIG. 8 is a partially sectioned enlarged side view of FIG. 7.

As shown in FIGS. 6, 7, and 8, when a manual turning force is applied to move the movable handle 70 toward the fixed handle 30 to permit the power end 911 to contact with the base seat 71, the movable jaw 50 is turned toward the fixed jaw 40. While the movable jaw 50 is turned toward the fixed jaw 40, the pivot pin 60 is disengaged from the second contour section of the inner tubular surface 521 of the pivot hole 52.

Figure 9:
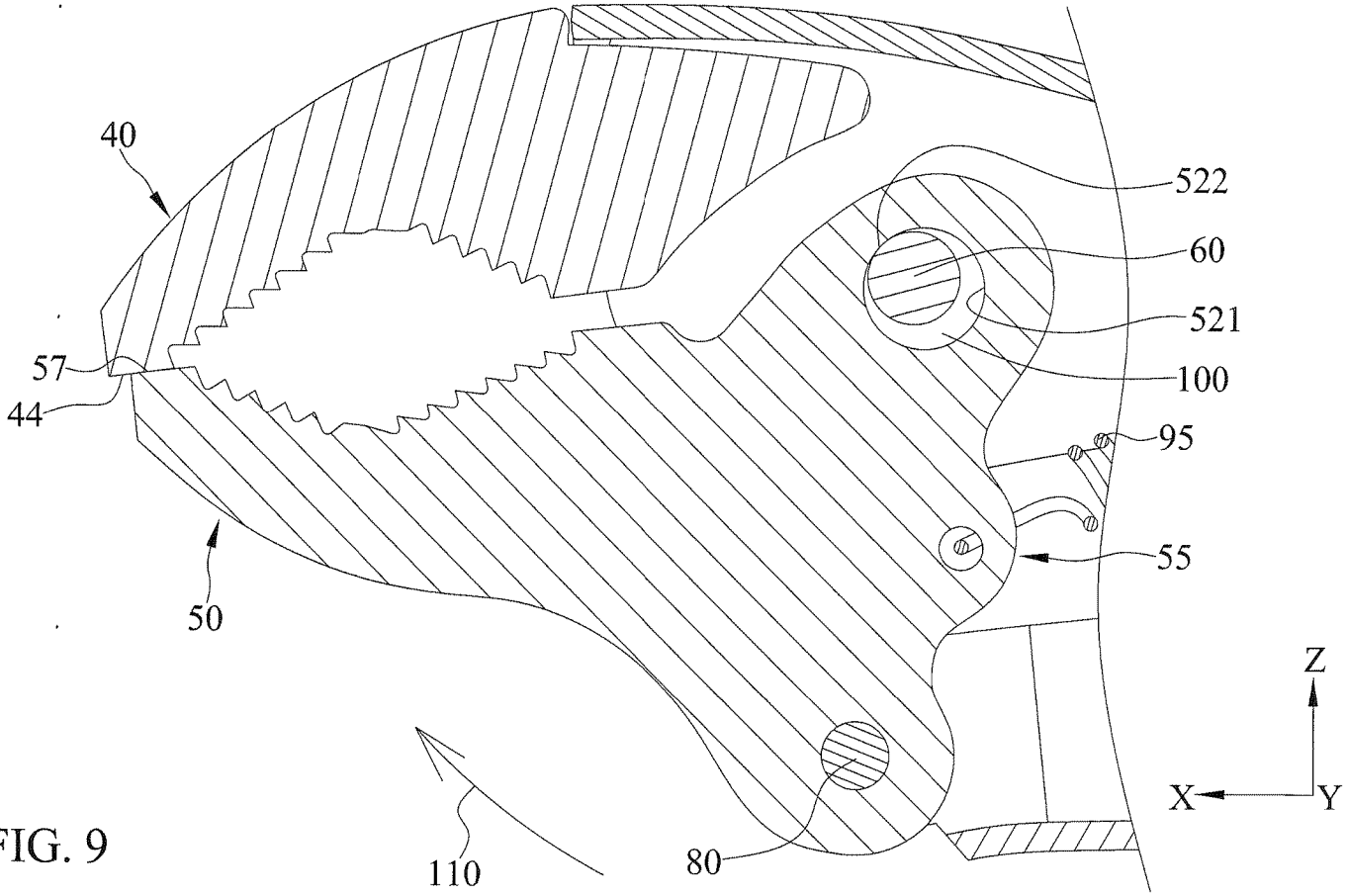
FIG. 9 is a partially sectioned enlarged side view of the preferred embodiment in a locking state.

As shown in FIGS. 7 and 9, the manual turning force is continued to be applied to the movable handle 70. Consequently, the second linkage 93 is turned clockwise about the second linking axis of the second linking pin 94. Hence, the movable jaw 50 is turned clockwise as indicated by the arrow 110 about the pivotal axis of the pivotal pin 80 against the biasing action of the biasing member 95, and the locking pliers is in the locking position thereof when the second nose end 57 abuts against the first nose end 44, when the pivot pin 60 is in abutting engagement with the middle region 522, and when the clearance 100 is disposed lower than the pivot pin 60 and between the pivot pin 60 and the inner tubular surface 521. The pivot pin 60 is also disengaged from the second contour section of the inner tubular surface 521 of the pivot hole 52 when the locking pliers is in the locking position thereof. In addition, when the movable jaw 50 is displaced from a position when the locking pliers is in the initial position thereof to another position when the locking pliers is in the locking position thereof, the lever wall 910 causes the second proximate end 931 to displace to a first over-center position in which the pivotal axis of the pivotal pin 80, the second linking axis of the second linking pin 94, and the second distal end 932 are in a near straight line with the first linking axis of the first linking pin 92, thereby holding the movable jaw 50 in a locking position thereof.

Figure 10:
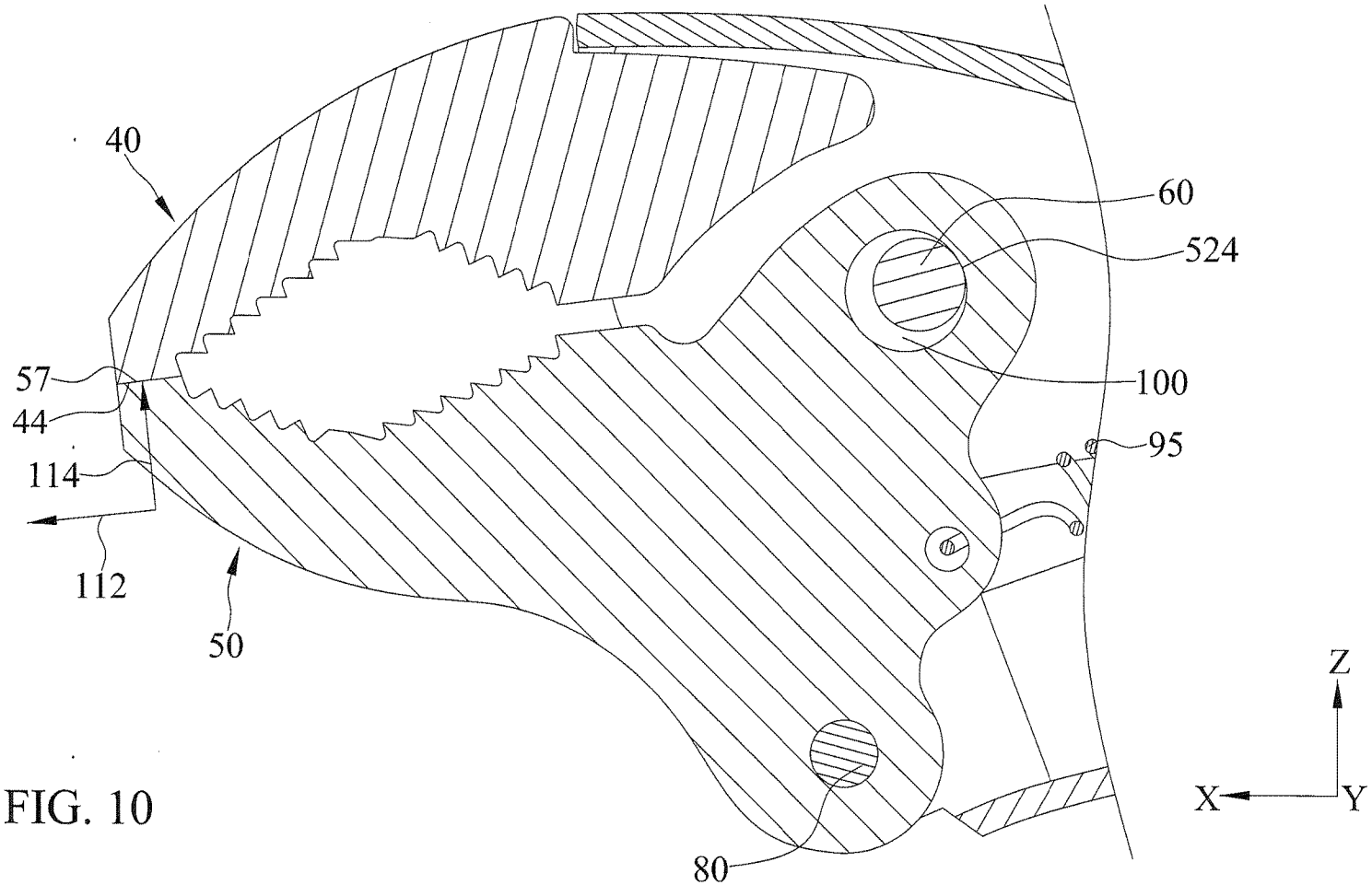
FIG. 10 is a partially sectioned enlarged side view of the preferred embodiment in a tightening state.

As shown in FIGS. 9 and 10, when the manual turning force is continued to be applied to the movable handle end 77 toward the rear handle portion 32 to permit the protrusion 933 to contact with the base seat 71, the movable jaw 50 is forced to turn clockwise about the pivotal axis of the pivotal pin 80 and is subject to a force component in a direction 112 to move forward and another force component in a direction 114 to bring the flat surfaces of the first and second nose ends 44, 57 into full abutment with each other. The locking pliers is in the tightening position thereof when the first and second nose ends 44 and 57 abut against one another, when the pivot pin 60 is permitted to be in abutting engagement with the leading region 524 and is spaced apart from the trailing region 525, and when the clearance 100 is disposed in front of the pivot pin 60 and between the pivot pin 60 and the inner tubular surface 521. The pivot pin 60 is also disengaged from the second contour section of the inner tubular surface 521 of the pivot hole 52 when the locking pliers is in the tightening position thereof. In addition, when the movable jaw 50 is displaced from the position when the locking pliers is in locking position thereof to a position when the locking pliers is in the tightening position thereof, the second proximate end 931 is caused by the lever wall 910 to turn about the second linking axis of the second linking pin 94 to be shifted to a second over-center position in which the pivotal axis of the pivotal pin 80, the second linking axis of the second linking pin 94, and the second distal end 932 are in a substantially straight line with the first linking axis of the first linking pin 92, thereby holding the movable jaw 50 in a tightening position thereof.

Therefore, once the manual turning force on the movable handle 70 is eliminated after continuing turning the movable jaw 50 clockwise about the pivotal axis of the pivotal pin 80, a friction force generated as a result of the abutting engagement between the pivot pin 60 and the leading region 524 counteracts the biasing action of the biasing member 95 to prevent the movable clamping surface 56 from moving away when the locking pliers is in the tightening position thereof. As a result, the gripping force between the fixed and movable clamping surfaces 43 and 56 is firm and stable during the operation of the locking pliers to the tightening position thereof.

When it is desired to release the movable jaw 50 from the tightening position thereof, an opposite manual turning force is applied to the movable handle 70 away from the rear handle portion 32 to permit the movable jaw 50 to move back to the initial position by the biasing action of the biasing member 95.

Figure 11:
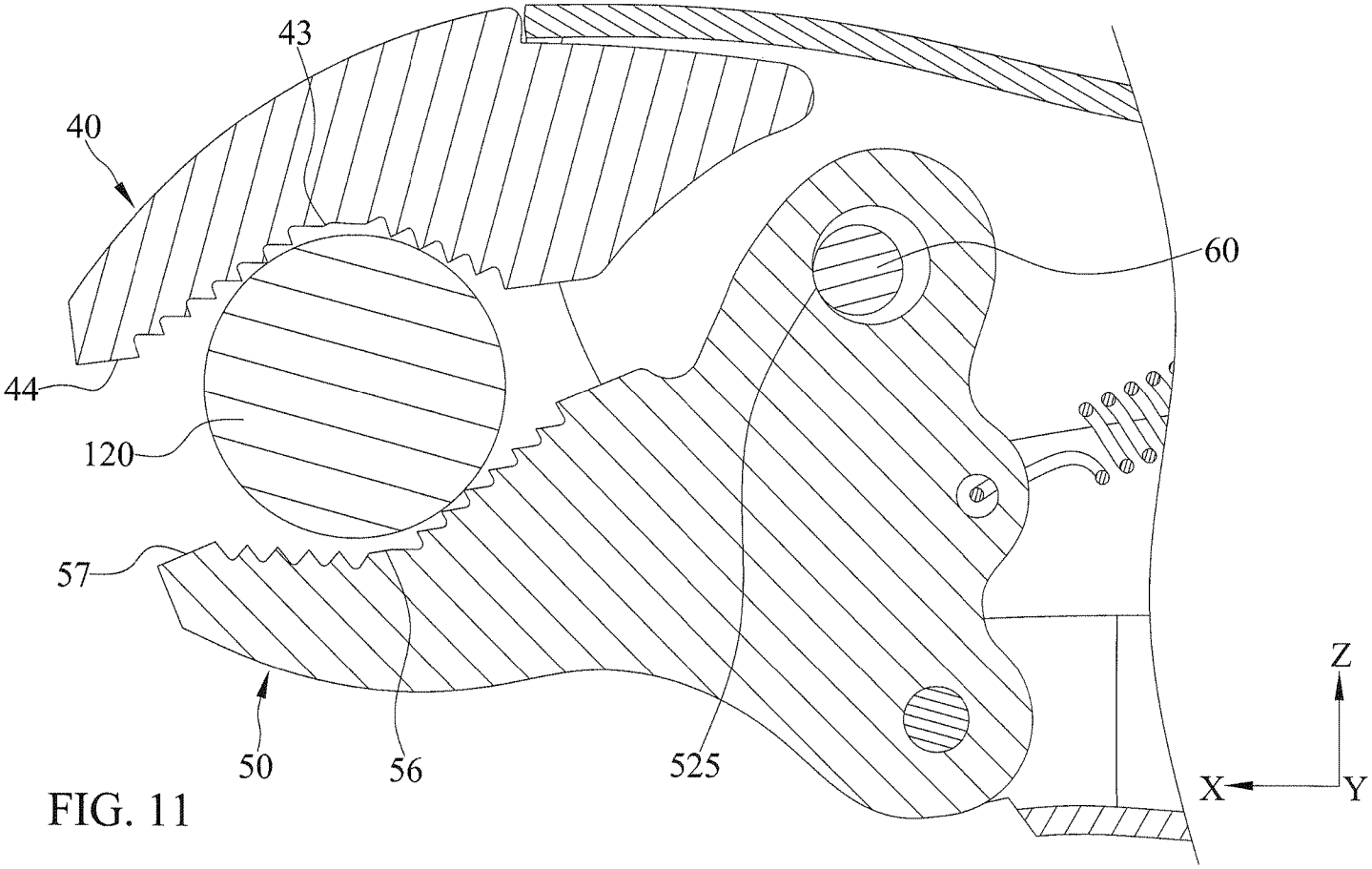
FIG. 11 is a partially sectioned enlarged side view of the preferred embodiment in a gripping state where a workpiece is gripped thereon.
Figure 12:
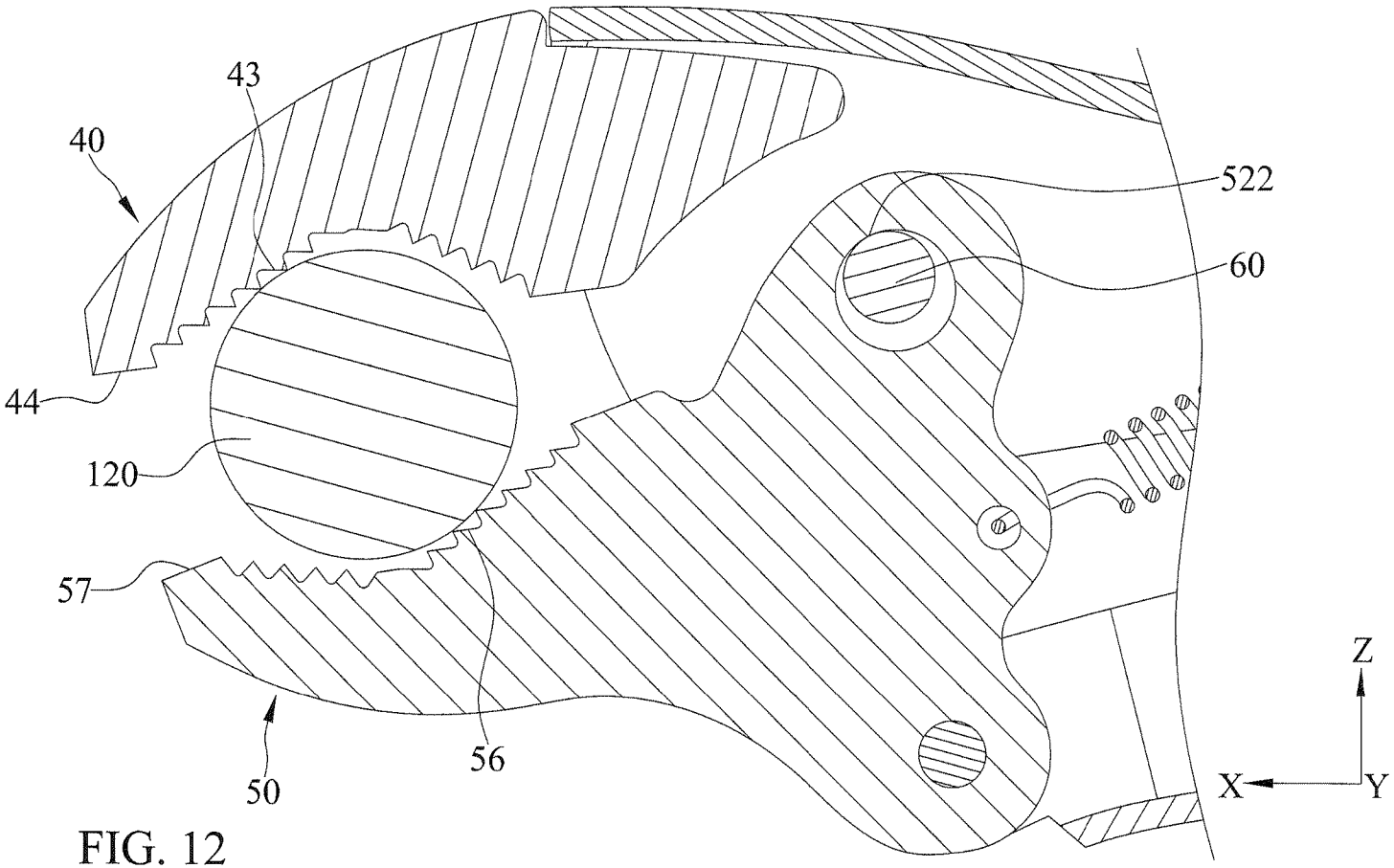
FIG. 12 is a partially sectioned enlarged side view of the preferred embodiment in a locking state on the workpiece.
Figure 13:
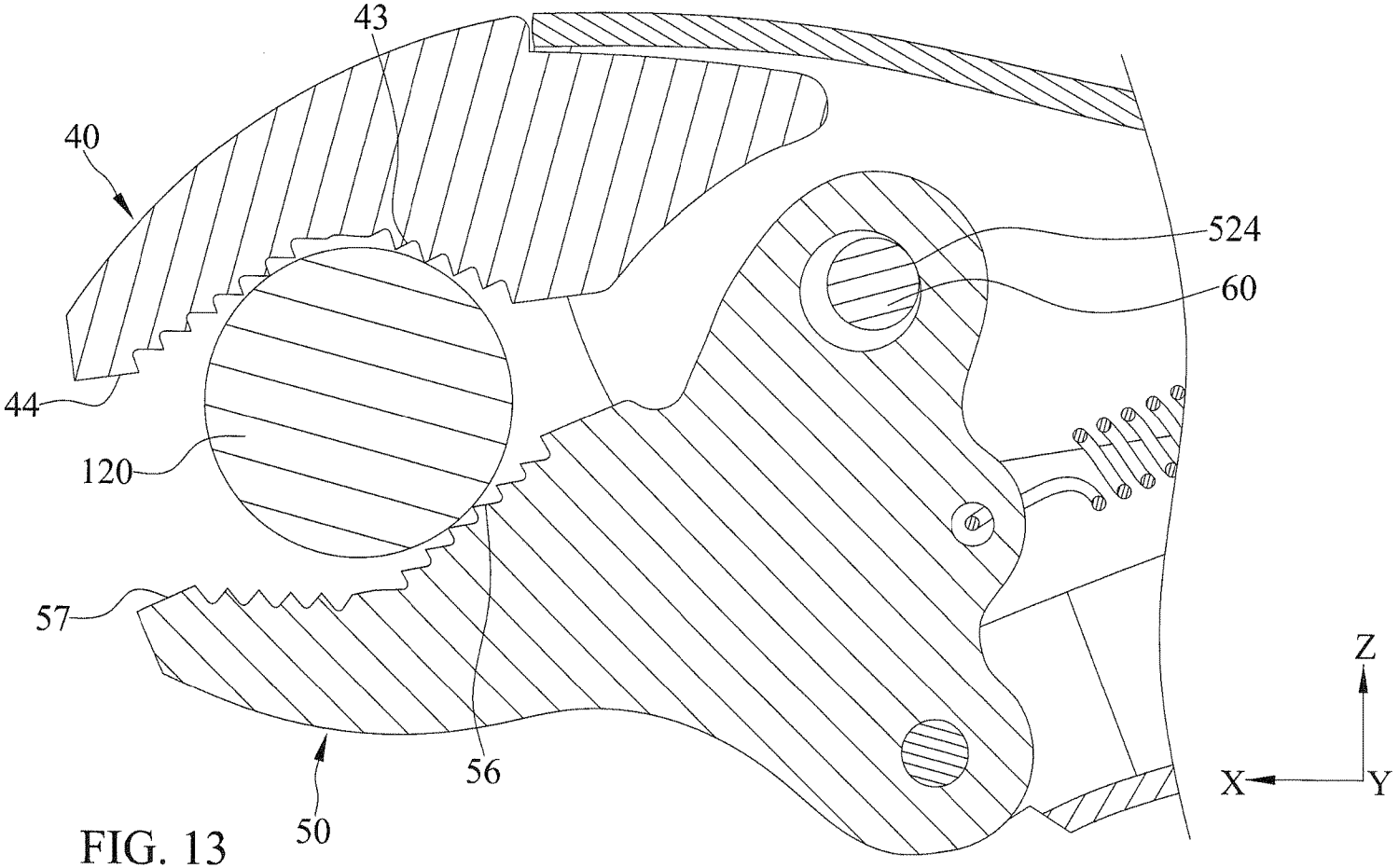
FIG. 13 is a partially sectioned enlarged side view of the preferred embodiment in a tightening state on the workpiece.

In use, referring to FIGS. 11 to 13, a workpiece 120 is shown to be gripped by the clamping surfaces 43 and 56. The workpiece 120 is gripped firmly with the concaved gripping teeth 46 and 59. Firstly, the movable jaw 50 is opened relative to the fixed jaw 40 so the workpiece 120 can be placed therebetween. Subsequently, the movable handle 70 is turned toward the rear handle portion 32 to turn the movable jaw 50 toward the fixed jaw 40, thereby permitting the clamping surfaces 43 and 56 to lock on the workpiece 120. Finally, the manual turning force is continued to be applied to the movable handle 70, and when the locking pliers is in the tightening position thereof, the movable jaw 50 is tightly gripped by the gripping teeth 46 and 59 of the respective clamping surfaces 43 and 56.

As illustrated, since the pivot pin 60 is kept in the abutting engagement with the inner tubular surface 521 during the operation of the locking pliers, and since the movable jaw 50 is moved forward and toward the fixed jaw 40 when the manual turning force is further applied to the movable handle 70 to displace the movable jaw 50 from the position when the locking pliers is in the locking position thereof to the position when the locking pliers is in the tightening position thereof, the gripping force is increased and stable.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A locking pliers comprising:

a fixed handle;

a fixed jaw connected securely to the fixed handle and including a first clamping surface;

a movable jaw cooperating with the fixed jaw and including a second clamping surface and movable and fixed pivoting regions;

a movable handle pivotally connected to the movable pivoting region about a pivotal axis;

a movable pivot unit including a pivot pin engaging with the fixed handle and the fixed pivoting region;

a pivot hole disposed in one of the fixed handle and the fixed pivoting region, with the pivot hole configured to form a contour of a circular shape defining trailing, middle and leading regions, with the circular shape of the pivot hole having a first diametrical size and the pivot pin having a second diametrical size not greater than 0.8 times the first diametrical size, with the pivot pin received and movable along an annular trajectory relative to the pivot pin in the pivot hole and partially abutting against the contour of the pivot hole; and a biasing member engaging with the fixed handle and the movable jaw, with the fixed handle and the movable jaw subject to a tensional force of the biasing member;

wherein the fixed and movable handles are movable from initial, locking, to tightening positions, the pivot pin has the annular trajectory in the pivot hole, and the movable jaw is pivoted closer toward the fixed jaw, and the pivot pin is in abutting engagement with the trailing, middle and leading regions defined from the contour of the pivot hole, respectively.

2. The locking pliers as claimed in claim 1, wherein the contour of the pivot hole defines a first contour section and a second contour section opposite the first contour section, wherein the trailing, middle and leading regions extend one after another and are angularly displaced from one another and are defined on the first contour section.

3. The locking pliers as claimed in claim 2, wherein the pivot pin is disengaged from the second contour section.

4. The locking pliers as claimed in claim 3, wherein the first and second contour sections delimit an inner periphery of the pivot hole.

5. The locking pliers as claimed in claim 3, wherein the pivot axis is in a fixed position relative to the movable handle and the movable pivoting region.

6. The locking pliers as claimed in claim 3, wherein the pivot pin has a circular contour.

7. The locking pliers as claimed in claim 2, wherein the pivot axis is in a fixed position relative to the movable handle and the movable pivoting region.

8. The locking pliers as claimed in claim 2, wherein the pivot pin has a circular contour.

9. The locking pliers as claimed in claim 1, wherein the pivot axis is in a fixed position relative to the movable handle and the movable pivoting region.

10. The locking pliers as claimed in claim 1 further comprising a lock unit including an adjustment screw to control a separating distance between the fixed and movable jaws, and wherein the adjustment screw is threadedly engaged with the fixed handle.

11. The locking pliers as claimed in claim 10, wherein the lock unit includes a linkage interconnecting the fixed and movable handles, wherein the linkage includes first and second linkages, wherein the first linkage has a first proximate end pivotally connected to the movable handle about a first linking axis and a first distal end, and wherein the second linkage has a second proximate end pivotally connected to the first distal end about a second linking axis and a second distal end connected to the fixed handle.

12. The locking pliers as claimed in claim 11, wherein the pivot axis, the linking axis and the second distal end are in a near straight line with the first linking axis when the fixed and movable handles are in the locking position thereof.

13. The locking pliers as claimed in claim 11, wherein the pivot axis, the linking axis and the second distal end are in a substantially straight line with the first linking axis when the fixed and movable handles are in the tightening position thereof.

* * * * *